US011519398B2

(12) United States Patent
Dole et al.

(10) Patent No.: US 11,519,398 B2
(45) Date of Patent: Dec. 6, 2022

(54) METHOD AND DEVICE FOR VENTING THE SUCTION SIDE OF A SYNTHETICALLY COMMUTATED HYDRAULIC PUMP

(71) Applicant: Danfoss Power Solutions GmbH & Co. OHG, Neumünster (DE)

(72) Inventors: Alexis Dole, Midlothian (GB); Luke Wadsley, Ames, IA (US)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 211 days.

(21) Appl. No.: 16/272,368

(22) Filed: Feb. 11, 2019

(65) Prior Publication Data

US 2019/0249670 A1 Aug. 15, 2019

(30) Foreign Application Priority Data

Feb. 14, 2018 (DE) ..... 102018103252.8

(51) Int. Cl.
*F04B 23/04* (2006.01)
*F04B 7/00* (2006.01)
(Continued)

(52) U.S. Cl.
CPC ..... *F04B 23/04* (2013.01); *F04B 1/0452* (2013.01); *F04B 7/0076* (2013.01); *F04B 23/02* (2013.01); *F04B 23/08* (2013.01); *F04B 23/10* (2013.01); *F04B 23/106* (2013.01); *F04B 49/22* (2013.01); *F04B 49/225* (2013.01); *F04B 49/243* (2013.01); *F04B 53/06* (2013.01); *F04B 53/1082* (2013.01)

(58) Field of Classification Search
CPC ..... F04B 7/0076; F04B 49/225; F04B 49/22; F04B 49/243; F04B 1/0452; F04B 1/06; F04B 23/04; F04B 23/02; F04B 23/08; F04B 23/10; F04B 23/106; F04B 53/06; F04B 53/1082
See application file for complete search history.

(56) References Cited

U.S. PATENT DOCUMENTS 6,016,786 A * 1/2000 Rodriquez-Amaya ..... F02M 41/125 123/299
6,116,870 A * 9/2000 Kraemer ..... F02M 59/464 417/490
(Continued)

FOREIGN PATENT DOCUMENTS

CN 204593958 U 8/2015
DE 3339679 A1 5/1985
(Continued)

OTHER PUBLICATIONS

European Search Report for Serial No. 19156386.5 dated May 9, 2019.

*Primary Examiner* — Peter J Bertheaud
(74) *Attorney, Agent, or Firm* — McCormick, Paulding & Huber PLLC

(57) ABSTRACT

The invention relates to a method of venting a synthetically commutated hydraulic pump (2). The connecting fluid conduits (8, 16), connecting said synthetically commutated hydraulic pump (2) with a fluid reservoir (7) is vented at least on start-up of the synthetically commutated hydraulic pump (2), using a fluid intake device (14, 17, 20) that connects to a fixed displacement pump (3).

24 Claims, 3 Drawing Sheets

(51) Int. Cl.

| | |
|---|---|
| ***F04B 53/10*** | (2006.01) |
| ***F04B 23/02*** | (2006.01) |
| ***F04B 53/06*** | (2006.01) |
| ***F04B 1/0452*** | (2020.01) |
| ***F04B 49/22*** | (2006.01) |
| ***F04B 49/24*** | (2006.01) |
| ***F04B 23/10*** | (2006.01) |
| ***F04B 23/08*** | (2006.01) |

(56) References Cited

U.S. PATENT DOCUMENTS

| | | | | |
|---|---|---|---|---|
| 6,722,857 | B1 * | 4/2004 | Kellner | F02M 55/00 123/446 |
| 7,377,753 | B2 * | 5/2008 | Kuroda | F02M 53/00 417/251 |
| 7,594,499 | B2 * | 9/2009 | Suzuki | F02M 37/32 123/446 |
| 7,677,872 | B2 * | 3/2010 | Beardmore | F04B 49/035 417/569 |
| 8,668,465 | B2 * | 3/2014 | Wadsley | F04B 49/08 417/244 |
| 9,091,253 | B2 * | 7/2015 | Stein | F04B 7/0057 |
| 9,816,502 | B2 | 11/2017 | Cedrone et al. | |
| 2015/0345489 | A1 | 12/2015 | Fink | |

FOREIGN PATENT DOCUMENTS

| | | | |
|---|---|---|---|
| EP | 2907386 | A1 | 8/2015 |
| FR | 548486 | A | 1/1923 |
| FR | 2560301 | A1 | 8/1985 |
| FR | 2596462 | A1 | 10/1987 |
| JP | 2006158625 | A | 6/2006 |

* cited by examiner

METHOD AND DEVICE FOR VENTING THE SUCTION SIDE OF A SYNTHETICALLY COMMUTATED HYDRAULIC PUMP

CROSS-REFERENCE TO RELATED APPLICATION

This application claims foreign priority benefits under U.S.C. § 119 to German Patent Application No. 102018103252.8 filed on Feb. 14, 2018, the content of which is hereby incorporated by reference in its entirety.

TECHNICAL FIELD

The invention relates to a fluid working machine arrangement, comprising a synthetically commutated hydraulic fluid working machine, having at least one working chamber with at least one actuated valve, wherein said at least one actuated valve fluidly communicates with a connecting fluid conduit. The invention also relates to a method of venting a synthetically commutated fluid working machine.

BACKGROUND

Hydraulic systems are used in a large number of various technological fields. They are both used for stationary devices, as well as for mobile applications (including ships, land vehicles and aircraft).

Due to the broad range of different applications, a correspondingly large number of different designs for hydraulic pumps, hydraulic motors and hydraulic fluid working machines (which can be used both as a motor and as a pump selectively) has been suggested in the meantime. All of these various hydraulic pumps/hydraulic motors/hydraulic fluid working machines have intrinsic advantages and disadvantages, so that depending on the detailed requirements of the application in question certain designs can show their intrinsic advantages (and are therefore selected), while other designs are disfavoured or even ruled out due to their intrinsic disadvantages.

There is a desire to avoid the intrinsic disadvantages that come along with a certain pump/motor design, so that the respective design can be universally applied, and the respective device the motor/pump is used in can be improved.

A unique design for fluid pumps/fluid motors/fluid working machines is the so-called synthetically commutated fluid working machine design, also known as Digital Displacement Pump® or DDP®. In case of a synthetically commutated hydraulic pump, the usually chosen passive inlet valve is replaced by an actuated valve, typically by an electrically actuated valve. During the intake cycle, when fluid is sucked into a pumping chamber of cyclically varying volume, the actuated valve is usually passively opened due to the pressure difference that develops between the fluid inlet channel and the interior of the pumping chamber. Consequently, fluid is sucked into the pumping chamber. Once the piston of the pumping chamber has reached its bottom dead centre the pressure difference across the fluid inlet valve will reverse. Contrary to standard pump designs, the fluid inlet valve will remain in its open position unless an (electric) signal to close the inlet valve will be applied by a controller. If the inlet valve remains open the fluid that is contained in the pumping chamber will be pushed back into the inlet conduit. Once the inlet valve closes, however, pressure will build up in the pumping chamber and the fluid will be ejected through a (usually passive) outlet valve to a high-pressure conduit. This way, the fluid output behaviour of the pump can be arbitrarily varied between all possible pumping fractions on a cycle-by-cycle basis. Furthermore, the synthetically commutated hydraulic pump design is very energy efficient since the pump consumes little energy only if the fluid is simply pushed back into the fluid inlet channel (and not against the high-pressure in the high-pressure conduit).

If the fluid outlet valves are replaced by active valves as well, a motor or a combined motor/pump design can be achieved as well by appropriately actuating the various inlet and outlet valves.

A particular problem with synthetically commutated hydraulic fluid working machine design lies in the initial start-up behaviour of synthetically commutated pumps specifically when they are used in open loop hydraulic circuits. The problem occurs if the pumping chamber and/or the fluid inlet channel is not (yet) filled with the "correct hydraulic fluid". Normally, the "correct hydraulic fluid" will be a liquid. On start-up ambient air can be present in the inlet conduit and/or the pumping chamber. Most likely start-up problems can occur when open loop hydraulic circuits are employed, especially if the fluid level of the fluid reservoir is below the fluid inlet channel of the synthetically commutated fluid working machine. In this situation, the synthetically commutated fluid working machine is usually not able to start pumping of hydraulic fluid on its own.

This poses a real problem in current designs using synthetically commutated fluid working machines. The solution that was so far employed in the state-of-the-art was to manually fill the crankcase using an oil inlet conduit of the fluid working machine by opening a gap and leading the oil flow through it by gravity, removing as much air as possible. This solution is of course impossible to implement when the hydraulic fluid reservoir is located below the fluid inlet channel of the synthetically commutated fluid pump itself, as previously mentioned.

This, however, is the case in most mobile applications, where traditionally the fluid storage tank is arranged in a way to be lower than the fluid working machine, since it is desired that any hydraulic fluid (including, but not limited to leakage oil) can be returned very simple to the fluid storage tank under the influence of gravity. In the described situation, the synthetically commutated fluid working machine might never be able to start or will start only with difficulty, and possibly with several cumbersome manual operational steps.

The situation of a start-up with a significant amount of air in the fluid inlet channel/the pumping chamber of the synthetically commutated fluid working machine cannot only occur after initial manufacture of the device, but also after a somewhat prolonged shutdown of the device due to small gaps through which air can enter into the respective fluid conduits. A weekend can easily be sufficient so that the discussed problems on start-up might occur.

It is therefore desired to come up with suggestions so that the afore described problems can be dealt with, in particular in a less cumbersome way.

SUMMARY

It is therefore the object of the invention to suggest a fluid working machine arrangement, comprising a synthetically commutated hydraulic fluid working machine that is improved over fluid working machine arrangements that are known in the state-of-the-art. It is another object of the invention to suggest a method of venting a synthetically commutated fluid working machine that is improved over methods of venting synthetically commutated fluid working machines that are known in the state-of-the-art.

The present suggestion solves these objects.

It is therefore suggested to design a fluid working machine arrangement that comprises a synthetically commutated hydraulic fluid working machine, having at least one working chamber with at least one actuated valve, wherein said at least one actuated valve fluidly communicates with a connecting fluid conduit in a way that said connecting fluid conduit comprises at least one venting device that is fluidly connected to a fluid intake device. In the fluid working machine arrangement, a single synthetically commutated hydraulic fluid working machine (also known as Digital Displacement Pump® or DDP® in particular in the case of a synthetically commutated hydraulic fluid pump) or a plurality of synthetically commutated hydraulic fluid working machines can be used. Albeit one, several or (essentially) all of the synthetically commutated hydraulic fluid working machines may have only one working chamber with at least one actuated valve, it is preferred if one, several or (essentially) all of the synthetically commutated hydraulic fluid working machines have a plurality of working chambers. In this way a larger and/or smoother fluid throughput can be achieved. The working chamber is typically a cavity, in which a piston or piston-like member is moved reciprocally (back and forth/up-and-down) so that the inner volume of the working chamber that is enclosed by the cylindrical cavity in combination with the piston member varies cyclically. This volume can be used for performing a pumping action, a motoring action, or both. It is to be noted that the working principle of a synthetically commutated hydraulic fluid working machine necessitates at least one actuated valve (where the actuation is usually performed using electrical means, i.e. an electrically actuated valve is present) in the case of a "pump only" design. In case a fluid motor and/or a combined fluid motor/pump is to be realized the respective pumping chambers have to have at least two actuated valves, one connecting to a low-pressure side, and one connecting to a high-pressure side, respectively. Therefore, it should be mentioned that the notion of a "synthetically commutated hydraulic fluid working machine" can cover a synthetically commutated hydraulic fluid pump "only", a synthetically commutated hydraulic fluid motor "only", and a machine that can be alternatively operated as a synthetically commutated hydraulic fluid pump and a synthetically commutated hydraulic fluid working motor. It should be noted that it is also possible that a synthetically commutated hydraulic fluid working machine comprises a plurality of working chambers wherein part of the working chambers are "pumping only chambers" (where they normally do show only a single actuated valve) while other working chambers show two actuated valves, fluidly connecting to different fluid conduits. Such a design might be advantageous in case the fluid flux to be pumped is regularly significantly higher as opposed to a fluid flux intake, when being operated in a motoring mode. Furthermore, the motoring section of such a synthetically commutated hydraulic fluid working machine might be used to drive in part the pumping section of the respective synthetically commutated hydraulic fluid working machine. It should be noted that (electrically) actuated valves that are suitable for use in a synthetically commutated hydraulic fluid working machine have to be able to be actuated in a reproducible and precise way (in particular when it comes to the timing), and further they have to be able to switch large valve poppets, even when a significant flux through the valve's orifice takes place. Therefore, such actuated valves are usually quite elaborate and therefore costly to manufacture, so even a partial reduction of the number of actuated valves that are needed is usually advantageous. Of course, a working chamber might be addressed as a "motoring chamber" in case of a "motor only", while it might be addressed as a "pumping chamber" in case of a "pump only".

In this context, it should be mentioned that usually pumps of the piston-and-cylinder type are self-starting. I.e. such pumps start pumping hydraulic fluid after a certain time, even if they are initially filled with air. This, however, is different with piston-and-cylinder type pumps of the synthetically commutated fluid working machine design. This can be (at least partially) attributed to the design of the switchable fluid valves that are used as fluid valves for the pumping chamber. Namely, present designs usually rely in part on hydrodynamic forces, when it comes to the actuated closing of the valve (this statement might also apply for opening the valve). I.e., while a significant part of the closing force of the respective valve comes from its actuator, a certain amount of the closing force comes from the fluid, passing through the valve's orifice as well. Therefore, if the pumping chamber is not sufficiently filled with comparatively viscous hydraulic oil, entrapped air might pass through the valve's orifice without creating a sufficiently large "supporting" closing force on the valve's orifice, resulting in that the valve closes late or not at all.

While it is possible that the venting is only performed during a certain time span on start-up, it is usually preferred if the intake of fluid (hydraulic fluid and/or entrapped air) into the venting device continues after the start-up process of the synthetically commutated fluid working machine has sufficiently proceeded/is completed, i.e. when the synthetically commutated fluid working machine pumps "real fluid" already. However, the intake of fluid into the venting device can stop after start-up as well (including a positive cutting-off of the venting device by means of a dedicated valve). Therefore, it is possible to make the choice on whether any fluid is taken in into the venting device or not, in dependence on requirements that are different from a venting requirement. Therefore, in the example of a venting device in form of a hydraulic pump that is used to pump hydraulic fluid for a different hydraulic consumer (for example a critical consumer like a hydraulic steering or a hydraulic break; as elucidated later on), a switching-on and a switching-off of the respective pump can be made in dependence of the respective hydraulic consumer's needs.

The situation that "venting" of the synthetically commutated hydraulic pump can continue, even if it is not required for purposes of venting the synthetically commutated fluid working machine, makes it possible to continuously maintain a fluid passage through the venting device. Therefore, no fluid switches are needed for this purpose, making the arrangement cheaper and additionally less prone to failures (as described in more detail later on).

As already previously discussed, a particular problem with synthetically commutated hydraulic fluid working machines is that they do have problems in case the "current" fluid inlet line has a too high content of gas, in particular contained in the hydraulic fluid that has to be pumped/is used for motoring by the respective fluid working machine (in particular a hydraulic liquid like hydraulic oil). Then, the synthetically commutated hydraulic fluid working machine is frequently not able to start at all. This problem might affect one, several or (essentially) all of the respective working chambers. The idea is to use a venting device, so that the undesired gas (usually ambient air) can be (actively and/or passively) removed from the respective fluid conduit and/or from the respective working chamber. It is possible that one venting device is sufficient for the respective connecting fluid conduit where the connecting fluid conduit might serve one, several or (essentially) all of the working chambers. However, it is also possible that two, three, four or even more venting devices are used for a connecting fluid conduit (the number of venting devices per fluid conduit might change from one fluid conduit to the other). In this context, it should be mentioned that typically a necessity for venting is only around once in a while (at least for purposes of venting). Usually, such a situation only occurs on initial start-up of the synthetically commutated hydraulic fluid working machine after manufacture or after extensive servicing, and sometimes after a somewhat elongated shutdown period (after a weekend, after a holiday break of a week or more, or the like). Therefore, adverse start-up conditions typically occur only rarely, like once a week or so. A "rough start-up" once a week is usually not too problematic and therefore typically a single venting device (per connecting fluid conduit) is usually sufficient. Furthermore, one, several or (essentially) all venting devices don't have to be relatively large in dimension since a rough start-up behaviour even for several minutes might be tolerable. Therefore, in the present technical field, solutions are possible, that would be not feasible in other technical fields. It should be also noted that a venting event does not necessarily mean that the venting device has to reduce the amount of undesired gas to a very low level (including, but not limited to, essentially 0), in particular in the present technical field of synthetically commutated fluid working machines. Instead the effect of the venting event is sufficient if the venting device reduces the amount of undesired gas to an extent that the working chamber(s) of the commutated hydraulic fluid working machine in question are able to commence with a "real pumping behaviour". Once such a "real pumping behaviour" has started, usually any amount of residual gas will be further reduced due to the pumping activity with respect to the hydraulic fluid. The undesired gas is typically the gas that is present around the synthetically commutated hydraulic fluid working machine, which is usually air. The hydraulic fluid that is used is typically hydraulic oil, sometimes water, or a different liquid as well. However, in principle all types of liquids are possible as a hydraulic liquid, for example a hypercritical fluid (where a distinction between liquid and gas cannot be made anymore), gases with a very high density, liquids with a certain amount of gas and/or solid particles, and so on. Irrespective of the detailed design, by using at least one venting device as proposed, the synthetically commutated hydraulic fluid working machine (and therefore the fluid working machine arrangement) is usually able to start working without manual intervention, at least under usual operating conditions. As already mentioned, the automatic start-up does not exclude a certain time delay on start-up until the pumping behaviour is actually established and/or a certain time span during which a not yet fully established pumping behaviour is present (including occurring noises, reduced fluid output flux and so on).

It is preferred to design the fluid working machine arrangement in a way that said synthetically commutated hydraulic fluid working machine comprises a plurality of working chambers. Preferably, a plurality of working chambers connect to a common connecting fluid conduit. This way a higher pumping/motoring action of the synthetically commutated hydraulic fluid working machine, and therefore of the fluid working machine arrangement can be achieved. Furthermore, it is not necessarily essential to increase the size of the actuated valve(s) unduly, which might be problematic. Another advantage of providing a plurality of working chambers is that usually a smoother fluid flow can be realized by a superposition of the fluid flows of the individual working chambers, in particular when using a common fluid conduit like a so-called manifold. While a design is possible, where one, several or (essentially) all working chambers connect to a respective individual fluid conduit, at least on one side (usually the high-pressure side; however, the low-pressure side is possible as well), in particular in case when several and/or individual consumers are to be supplied it is usually preferred if at least some of or (essentially) all of the working chambers connect to a common fluid conduit (a so-called manifold) on at least one side (typically the low-pressure side; but alternatively or additionally the high-pressure side is possible as well). It is even possible that fluid switches (some kind of valves) are used to alternatively connect individual working chambers to different (common) fluid conduits.

It is further suggested to design the fluid working machine arrangement in a way that for at least one of said working chambers said actuated valves connect to a common connecting fluid conduit and/or to design the fluid working machine arrangement in a way that at least part of said synthetically commutated hydraulic fluid working machine is designed as a synthetically commutated hydraulic fluid pump. When the synthetically commutated hydraulic fluid working machine is designed in such a way, it is particularly prone to start-up difficulties due to a high content of air (or other disadvantageous gas pockets) in the fluid inlet line. Therefore, the presently proposed use of at least one venting device can provide a possibility for a start-up even under relatively adverse conditions, in particular without manual user activity. Furthermore, it is to be noted that usually no other sensible way of providing an automated start-up of the synthetically commutated hydraulic fluid working machine is possible, if such a pump design is present. While in case the fluid working machine can be operated in a motoring mode as well, it is possible to fill the fluid inlet line (seen with respect to a pumping mode) by employing a motoring mode for a certain time and thus filling the fluid inlet line with hydraulic fluid (at least to an extent that will be sufficient for providing a "real" pumping mode of the fluid working machine afterwards). This is not possible if a "pump only design" is present. However, such a motoring mode might not work for the reasons discussed below. Therefore, the advantages of the presently proposed invention are particularly predominant.

Furthermore, it is suggested to design the fluid working machine arrangement in a way that said synthetically commutated hydraulic fluid working machine comprises at least one working chamber with at least two actuated valves, wherein said at least two actuated valves preferably connect to different connecting fluid conduits. Using such a design, the synthetically commutated hydraulic fluid working machine can be operated in a motoring mode (at least at times) which leads to a more universal applicability of the synthetically commutated hydraulic fluid working machine, and thus of the resulting fluid working machine arrangement. Furthermore, apart from the already proposed venting device, an alternative possibility of venting the inlet channel can be used additionally and/or alternatively by operating the synthetically commutated hydraulic fluid working machine for a certain time span in a motoring mode, thus filling the fluid inlet connection (when seen in a pumping mode), as discussed above. Nevertheless, providing at least one venting device is still more than welcome, since it is not too uncommon that for a start-up phase such a reversed operation (i.e. operating the synthetically commutated hydraulic fluid working machine in a motoring mode) is not possible for whatever reason (for example due to lack of sufficient hydraulic fluid in the high-pressure line or the like). The different connecting fluid conduits according to the presently proposed embodiment are particularly to be understood as a high-pressure fluid line and a low-pressure fluid line. Of course, the connecting fluid conduits can be in fluid communication with different working chambers as well, forming a fluid manifold.

Furthermore, it is suggested to design the fluid working machine arrangement in a way that for at least two different connecting fluid conduits each of said fluid conduit comprises a venting device, wherein preferably fluid switches are used to selectively connect to said venting devices with said fluid intake device. This way, it is possible that the respective synthetically commutated hydraulic fluid working machine can be operated in any direction, and yet a venting of the respective current fluid intake line is possible, since such a venting device is arranged on both sides of the device. The fluid switch (some kind of a valve) is preferably of an actuated type, where the actuation might depend on pressure differences and/or on an input signal that can be provided by a controller in the form of an electric, hydraulic or pneumatic signal or a signal of a different type. In case two or more different signals are used, a combination of signals of (partially) the same type or signals of (partially) a different type can be used. Furthermore, absolute signals can be used, as well as differential signals. Preferred, however, is an (at least partially) electrically actuated fluid switch since such a fluid switch and/or the generation of an appropriate/suitable input signal can be particularly easy and reliable. Even in this context, it is possible to continue venting of the synthetically commutated fluid working machine, even after its start-up process has been sufficiently proceeded/completed (where "sufficiently proceeded" can mean that venting of the synthetically commutated fluid working machine has proceeded to a level that it can maintain "real pumping" of fluid). Therefore, while the use of a fluid switch is proposed in the present context for purposes of choosing from which side a fluid intake into the venting device takes place, there is still no need for using an on-off-switching device for allowing or inhibiting a fluid passage through the venting device (albeit such a device might be present).

Furthermore, it is proposed to design the fluid working machine arrangement in a way that at least one venting device is designed, at least in part, as a fluid orifice and/or as a check valve device and/or as a single way fluid throughput device. This way, a particularly simple device can be used. In particular, no on-off-switching device is required. In other words: a fluid passage through the venting device can be permanently established. Furthermore, any wrong actuation can usually be avoided since such devices can be actuated by an input signal that is very reliable (for example by the pressure difference across the venting device itself, when using a check valve design). It is even possible that apart from such very simple venting devices (essentially) no additional devices are used. Nevertheless, such devices might prove to be sufficient for a sufficient venting of the fluid input conduit in combination with the operating characteristics of the synthetically commutated fluid working machine. In particular, if the synthetically commutated hydraulic fluid working machine is operated in an idle mode (fluid inlet valve remains open for both the fluid intake phase, and the fluid output phase during the working cycle of the respective working chamber) or used in part-stroke mode (where the fluid inlet valve is closed at a certain position during the fluid output phase (contraction phase of the working chamber), fluid and/or gas is expelled back to the fluid inlet channel resulting in at least a certain pressurisation (which might occur only due to dynamical forces). This might be sufficient to successively reduce the content of unwanted gas in combination with the venting device, so that after a certain time span a real pumping behaviour with respect to the hydraulic fluid in question might be achieved.

Furthermore, it is suggested to design the fluid working machine arrangement in a way that said at least one fluid intake device is designed as an active fluid intake device, preferably taken from the group comprising fluid working machines, fixed displacement fluid working machines, variable displacement fluid working machines, cogwheel fluid working machines, piston fluid working machines, passive-valves fluid working machines, non-synthetically commutated fluid working machines, scroll fluid working machines, Gerotor fluid working machines, fluid pumps, fixed displacement fluid pumps, variable displacement fluid pumps, cogwheel fluid pumps, piston fluid pumps, passive valve fluid pumps, non-synthetically commutated fluid pumps, scroll fluid pumps, and Gerotor fluid pumps. Using such an embodiment, it is usually possible to provide a venting of the inlet channel(s) of the fluid working machine arrangement even under comparatively adverse conditions and/or comparatively fast and/or to a large extent. This can lead to the effect that unwanted time delays before the fluid working machine arrangement is essentially ready for use can be particularly short. Furthermore, annoying noises, increased wear of the machine and the like can be reduced as well, possibly even with little additional effort and/or without introducing too high energy losses. It is to be noted that for a range of applications, additional pumps (in addition to the main pump) are used anyhow, for example to provide a very high fluid pressure, a hydraulic fluid flux for very critical hydraulic consumers, a fluid flux for different circuits (for example for a different type of hydraulic circuit, like for a closed fluid circuit). In particular, such an additional pump can be used for supplying pressurised fluid for hydraulic consumers that are different from the hydraulic consumers that are supplied by the synthetically commutated hydraulic pump. However, it is also possible that the respective pump can be used as a charge pump for the synthetically commutated hydraulic pump. Therefore, both pumps might at least partially and/or at least at times serve the same hydraulic consumers. If such an additional pump is used this pump can be used as an active fluid intake device for the synthetically commutated hydraulic fluid working machine as well. This can prove to be a very simple and efficient design. In particular, when choosing such a design, it is usually not necessary (or even not desired) to stop the intake of fluid into the venting device, once the start-up process for the synthetically commutated hydraulic pump has been completed. Therefore, the overall design can be comparatively simple and failsafe. In particular, no on-off-switching device is necessary to allow or to inhibit fluid flow through the fluid venting device. In other words: a fluid passage through the venting device can be permanently established. As a side remark: in the present technical field of hydraulics, active fluid intake devices are usually quite expensive. So providing an active fluid intake device is usually not viable from a commercial aspect.

Furthermore, it is suggested to design the fluid working machine arrangement in a way that said synthetically commutated fluid working machine is designed and arranged for use in an open fluid hydraulic circuit and/or in a way that at least said synthetically commutated fluid working machine fluidly connects to at least a fluid reservoir, either directly and/or indirectly. It is to be noted that for these designs, the problem with a rough start-up when a too high content of air is around in the fluid intake line of the synthetically commutated hydraulic fluid working machine is usually particularly profound and/or occurs comparatively often. Therefore, the intrinsic features of the presently proposed design can be particularly advantageous.

Furthermore, it is suggested to design the fluid working machine arrangement in a way that said at least one fluid intake device is designed and arranged for use in an open fluid hydraulic circuit and/or in that it connects to said at least one venting device and/or to at least one alternative fluid source, in particular to a fluid reservoir. In particular, the respective fluid connections (or parts thereof) can be designed to be (essentially) permanent. This way, it is usually possible that the fluid intake device can fulfil its task with respect to venting the synthetically commutated hydraulic fluid working machine without too strong adverse influences on its own behaviour. It is both possible that the fluid intake device intakes the majority or most of its fluid intake flux directly from an alternative fluid source (like a fluid reservoir), while only a small fraction comes from the at least one venting device. However, it is also possible that the majority or even (essentially) all of the fluid input flux into the fluid intake device comes from the venting device. This is somewhat equivalent to the case where a common fluid input line for both the fluid intake device and the synthetically commutated hydraulic fluid working machine is used, for example coming from a fluid reservoir, where the common fluid input line is split up into two divisional lines at a certain branching point.

Furthermore, it is suggested to design the fluid working machine arrangement in a way that said at least one venting device and/or the fluid connection between said at least one venting device and said fluid intake device comprises a fluid throughput restriction means and/or in a way that is designed, at least in part, as a fluid throughput restriction means. In particular, the respective fluid connections (or parts thereof) can be designed to be (essentially) permanent. Using this design, the majority of the fluid flow input of the fluid intake device comes directly from an alternative fluid source. This can be advantageous in case the fluid intake device serves as an auxiliary pump for a different hydraulic circuit part for providing a minimum fluid flux or the like. Using this proposal, usually the venting of the synthetically commutated hydraulic fluid working machine takes a little bit longer in time, but the overall behaviour, in particular any efficiency losses of the overall fluid working machine arrangement, might be improved. Said fluid throughput restriction means is preferably a fixed and/or a variable fluid throughput restriction means. In case two (or even more) fluid restriction means are used (arranged in parallel and/or in series), a combination of a fixed and a variable fluid throughput restriction means can be particularly advantageous, for example by guaranteeing a minimum fluid flow throughput and/or a minimum fluid flow hindrance, respectively. A minimum fluid flow throughput (by using a combination of a fixed and a variable fluid throughput restriction means and/or by using a variable fluid throughput restriction means comprising an orifice with a minimum fluid throughput) can safeguard a start-up possibility, even if there is a malfunction of the variable fluid throughput restriction means. This is of course very advantageous. However, a start-up might necessitate a relatively long timespan in such a case.

Furthermore, it is suggested to design the fluid working machine arrangement in a way that at least one venting device is arranged at least in the vicinity of the locally highest point of the respective connecting fluid conduit. Using such a design, the removal of an adverse gas content is usually performed at the point where pockets of the adverse gas will be around most likely due to gravity. Therefore, the venting process will usually be very efficient and/or the venting process can be performed up to a point, where only a comparatively small residual content of adverse gas will remain in the fluid working machine arrangement.

Another possible embodiment of a fluid working machine arrangement can be realised, if said at least one venting device connects to said synthetically commutated hydraulic fluid working machine, in particular to an interior volume and/or an interior part of said synthetically commutated hydraulic fluid working machine. The fluid connection can be of an (essentially) exclusive fluid connection type (meaning that essentially all of the fluid flow intake of an auxiliary pump comes from a synthetically commutated hydraulic fluid working machine), but can also be of an auxiliary fluid connection type (meaning that at least at times/in certain working modes only a—typically small—fraction of the fluid intake into an auxiliary fluid pump comes from the synthetically commutated hydraulic fluid working machine, while the remaining part—usually the main part—comes from an alternative fluid source, like a hydraulic fluid reservoir). Using such a design a particularly effective venting of the synthetically commutated hydraulic fluid working machine can be realised. The fluid intake within the synthetically commutated hydraulic fluid pump can connect to a crankcase (preferably a vertically higher part of the crankcase) and/or any volume part of the synthetically commutated hydraulic fluid pump that is prone to an accumulation of air (a plurality of intakes is possible as well, of course). The presently proposed fluid connection(s) can be made to sections of the synthetically commutated hydraulic fluid working machine that are at least at times (significantly) pressurised. However, it is also possible that the presently proposed fluid connection(s) is (are) made, at least in part, to sections of the synthetically commutated hydraulic fluid working machine that are usually not (significantly) pressurised. It is to be noted that even if a fluid intake takes place from a pressurised region, this is not necessarily causing a relevant loss of energy. This is because mechanical power requirements/pumping work, in particular pumping work for an active venting device, can be reduced thanks to the elevated input pressure of the respective device.

It is to be noted that the presently proposed design is particularly useful if the fluid reservoir is arranged at a level that is lower than the level of the synthetically commutated hydraulic fluid machine, in particular its respective fluid inlet line.

Furthermore, a method of venting a synthetically commutated fluid working machine is a suggested, in which at least one of the connecting fluid conduits, connecting said at least one synthetically commutated fluid working machine with a different hydraulic device is vented at least at times of the working interval of said synthetically commutated fluid working machine, using a fluid intake device. Preferably, the venting is done at least at the beginning of the working interval of said synthetically commutated fluid working machine. When employing the proposed method, similar advantages as previously discussed can be realized, at least in analogy. In particular, the previously discussed features and modifications, as stated with respect to the fluid working machine arrangement, can be applied to the presently proposed method as well, at least in analogy. Using such a method, it is possible to use synthetically commutated hydraulic fluid working machines in a broader range of applications and/or with less manual input and/or with fewer problematic effects. This is usually advantageous.

In particular, it is possible to employ the presently proposed method for a fluid working machine arrangement of the aforementioned and afore described type.

BRIEF DESCRIPTION OF THE DRAWINGS

Further advantages, features, and objects of the invention will be apparent from the following detailed description of the invention in conjunction with the associated drawings, wherein the drawings show.

DETAILED DESCRIPTION

Figure 1:
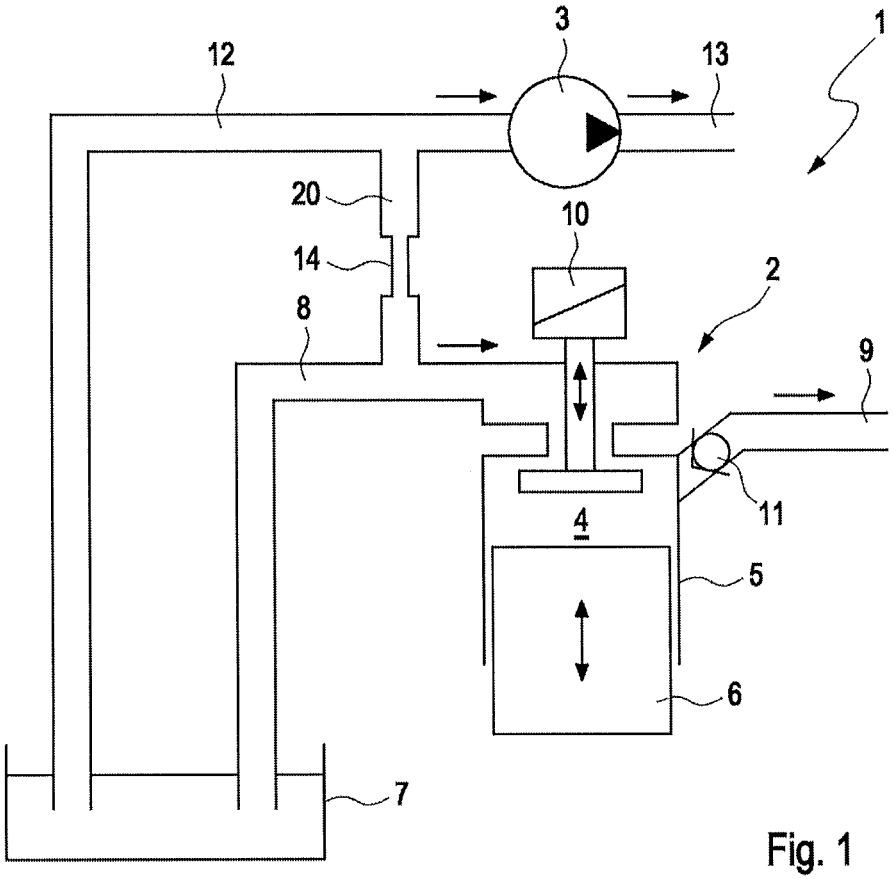
FIG. 1: a first possible embodiment of a fluid pump arrangement in a schematic view.

In FIG. 1, a fluid pump arrangement 1 is shown in a schematic view. The fluid pump arrangement 1 comprises a synthetically commutated fluid pump 2 (also known as DDP® or Digital Displacement Pump®) and a non-synthetically commutated fluid pump, presently a fixed displacement pump 3.

The synthetically commutated fluid pump 2 comprises a pumping chamber 4 that is defined by a cylindrical cavity 5 and a piston 6 that moves up and down within the cylindrical cavity 5. Therefore, the pumping chamber 4 comprises a repetitively changing volume that is used for pumping hydraulic fluid from a fluid reservoir 7 via a low-pressure line 8 to a high-pressure line 9. The fluid reservoir 7 is essentially at ambient pressure, so the fluid pump arrangement 1 serves a so-called open loop hydraulic circuit.

The synthetically commutated fluid pump 2 design is as such known in the art. An electrically actuated low-pressure valve 10 connects and disconnects the low-pressure line 8 and the pumping chamber 4 selectively. When the piston 6 goes down, the volume of the pumping chamber 4 increases and the low-pressure valve 10 opens due to the pressure differences. When the piston 6 has reached its lower dead centre, the piston 6 will start to move up again, the pumping chamber 4 decreases in volume, and fluid is pushed out of the pumping chamber 4.

If the electrically actuated low-pressure valve 10 is closed by an appropriate actuation signal, pressure will build up in pumping chamber 4 and fluid will be pressurised and ejected through check valve 11 to the high-pressure line 9. However, if no closing signal is applied, the low-pressure valve 10 remains open and fluid in the pumping chamber 4 will be simply pushed back into low-pressure line 8 and fluid reservoir 7 again. Since no significant pressure difference has to be overcome, only very little mechanical energy is consumed in this mode.

As can be seen, the synthetically commutated fluid pump 2 can be switched between a full-stroke mode (closing of the low-pressure valve 10 at the bottom dead centre of the piston 6) and an idle mode (low pressure valve 10 remains open) on a cycle-by-cycle basis.

Furthermore, it is possible to close the electrically actuated low-pressure valve 10 while the piston 6 moves upward and the volume of the pumping chamber 4 contracts. This way, a certain volume being equivalent to a certain fraction of the total volume of the pumping chamber 4 can be pumped towards the high-pressure line 9 (part-stroke mode).

The described situation applies when the synthetically commutated fluid pump 2 operates positively, in particular when the low-pressure line 8 is completely filled with hydraulic oil (or any other type of hydraulic fluid).

However, a different situation can occur, in particular due to the presently depicted geometrical arrangement of the various components of the fluid pump arrangement 1 in which the fluid reservoir 7 is arranged to be lower than the synthetically commutated fluid pump 2. Here, after initial manufacture of the fluid pump arrangement 1 or after an extensive servicing of the fluid pump arrangement 1, the low-pressure line 8 and/or the pumping chamber 4 will be filled with entrapped air, at least to a certain extent. A similar or even the same situation might occur after a somewhat extended shut down period of the fluid pump arrangement 1. A weekend or a one-week holiday break might be sufficient for this situation to occur (as an example). This is because small gaps might be around in the fluid arrangement 1 so that air can enter the various components and hydraulic oil will eventually flow into the fluid reservoir 7. In this context, it should be mentioned that all devices (in particular the synthetically commutated fluid pump 2 and the fixed displacement pump 3) might show a certain fluid leakage, where the leakage oil is usually returned back to the fluid reservoir 7 by means of leakage oil lines (not shown). This usually includes the various hydraulic consumers (not shown) that are served through the high-pressure line 9 of the synthetically commutated fluid pump 2 and/or the fixed displacement pump 3.

When air is entrapped in the low-pressure line 8 and/or the pumping chamber 4, a synthetically commutated fluid pump 2 is normally not able to start pumping hydraulic oil on its own. As already described, this can be due to the fact that the actuated valve 10 closes late or not at all, if a too high content of air is present. Instead, air that is entrapped in the low-pressure line 8 and/or the pumping chamber 4 will simply be pressurised and depressurized. A successive filling of the low-pressure line 8 and/or the pumping chamber 4 with time is normally not (yet) effectuated, in particular if the air content is above a certain critical margin. Once this critical margin has been reached, usually a condition will be reached where the remaining residual air will be successively pumped toward the high-pressure line 9 in the course of several pumping cycles (some kind of a hydraulic oil foam will be pumped).

The fixed displacement pump 3 is arranged in parallel to the synthetically commutated fluid pump 2. In particular, it is possible that both pumps 2, 3 are driven by the same energy source (for example a combustion engine, an electric motor or the like; not shown). However, different energy sources are possible as well, of course.

The fixed displacement pump 3 also intakes oil from the fluid reservoir 7 through a low-pressure line 12 and ejects the pressurised fluid to its high-pressure line 13. While it is possible that the high-pressure line 9 of the synthetically commutated fluid pump 2 and the high-pressure line 13 of the fixed displacement pump 3 are combined to serve the same hydraulic consumer, this is normally not the case. Instead, usually the high-pressure line 13 of the fixed displacement pump 3 serves a different consumer. Usually, a critical hydraulic consumer is served that provides a critical safety feature. An example for this is a hydraulic steering, hydraulic brakes or similar functions of a forklift truck. This also means that the fixed displacement pump 3 may continue to pump irrespective of the fact that the start-up process for the synthetically commutated fluid pump 2 is (sufficiently) sufficiently proceeded/completed. Indeed, the decision on whether the fixed displacement pump 3 pumps, or does not pump (including the fluid flow rate of the pumped fluid) can be based on different considerations, for example on the actual fluid flow requirements by the consumer(s) that is (are) served by the fixed displacement pump 3.

The fixed displacement pump 3 can be essentially of any type. As an example, it could be a cogwheel pump, a Gerotor pump, a standard piston-and-cylinder pump or the like. Furthermore, the fixed displacement pump 3 can be even of a variable pump design (not shown in the present embodiment), for example a wobble plate pump or a swash plate pump.

The fixed displacement pump 3 is of a design that it provides an automatic start-up, i.e. it can pump air as well. Therefore, if air is entrapped in the low-pressure line 12 and/or the fixed displacement pump 3, hydraulic oil that is contained in the fluid reservoir 7 will be successively sucked in, eventually replacing the entrapped air in low-pressure line 12 and/or fixed displacement pump 3. This can easily take several seconds or several tens of seconds (just to name an example). Even if the start-up takes a minute or more this is usually not a problem since such a start-up phase typically only occurs after a comparatively prolonged shutdown time of the arrangement 1. If, for example, such a start-up is necessary after a weekend, such a start-up will only take place once a week. So, a start-up time even in the order of minutes is negligible.

According to the present suggestion, the ability of the fixed displacement pump 3 for a start-up on its own will be used for the synthetically commutated fluid working machine 2.

This is effectuated by a fluid throttle 14 (where the fluid throttle 14 can be of a type with a fixed size of the orifice, but also with a variable size of the orifice, where the size of the orifice can be changed using an appropriate actuator). Usually, however, there is always a certain fluid flow connectivity through the fluid throttle 14 remaining. This reduces the amount of required components. (However, an on-off-functionality might be envisaged as well.) Furthermore, such a design can guarantee a failsafe fallback position: even if the fluid flow through the fluid throttle 14 is very limited, a start-up of the synthetically commutated fluid pump 2 is still possible (although the required time might be comparatively long). The fluid throttle 14 forms part of the venting line 20 that connects the low-pressure line 12 of the fixed displacement pump 3 with the low-pressure line 8 of the synthetically commutated fluid pump 2. The cross-sectional size of the fluid throttle 14 is significantly lower than the cross sections of the two low-pressure lines 8, 12.

On start-up of the fluid pump arrangement 1, the synthetically commutated fluid pump 2 will be initially in a mode where it is "stuck" (i.e. it is not able to start-up on its own due to the air entrapped in the low-pressure lines 8, 12 and/or the pumping chamber 4). The fixed displacement pump 3, however, will successively pump air to the high-pressure line 13, so that at a certain point the low-pressure line 12 will be filled with hydraulic oil. In parallel, a slight amount of air will also pass through the fluid throttle 14. Therefore, low-pressure line 8 of the synthetically commutated fluid pump 2 will eventually fill up with hydraulic oil from the fluid reservoir 7 as well, although this usually takes longer as compared to the filling time of the fixed displacement pump's 3 low-pressure line 12. Nevertheless, at a certain point the amount of entrapped air in the synthetically commutated fluid pump 2 and/or its low-pressure line 8 will be sufficiently low, so that the synthetically commutated fluid pump 2 will start to pump actively. It is to be noted that initially the pumping ability of the synthetically commutated fluid pump 2 is possibly lower as compared to its nominal value, since initially still entrapped residual air is simply pressurised and depressurized. However, with time the content of residual air will fade (normally due to the fact that "hydraulic oil foam" will be pumped by the synthetically commutated fluid pump 2, so that after a certain time span the synthetically commutated fluid pump 2 will be fully vented and will be able to operate at nominal performance.

In other words, an automatic start-up of the fluid pump arrangement, including both the synthetically commutated fluid pump 2 and the fixed displacement pump 3 is possible by virtue of the fluid throttle 14.

In particular, a fluid intake into the fluid throttle 14 may continue, even when the start-up sequence of the synthetically commutated fluid pump 2 is sufficiently proceeded/completed. No on-off-fluid valve is needed for this purpose. The respective fluid passage may be present permanently.

It is to be noted that the start-up time that is required for this embodiment (and other embodiments as well) might have a duration that makes it practically unusable for certain technical applications.

Figure 2:
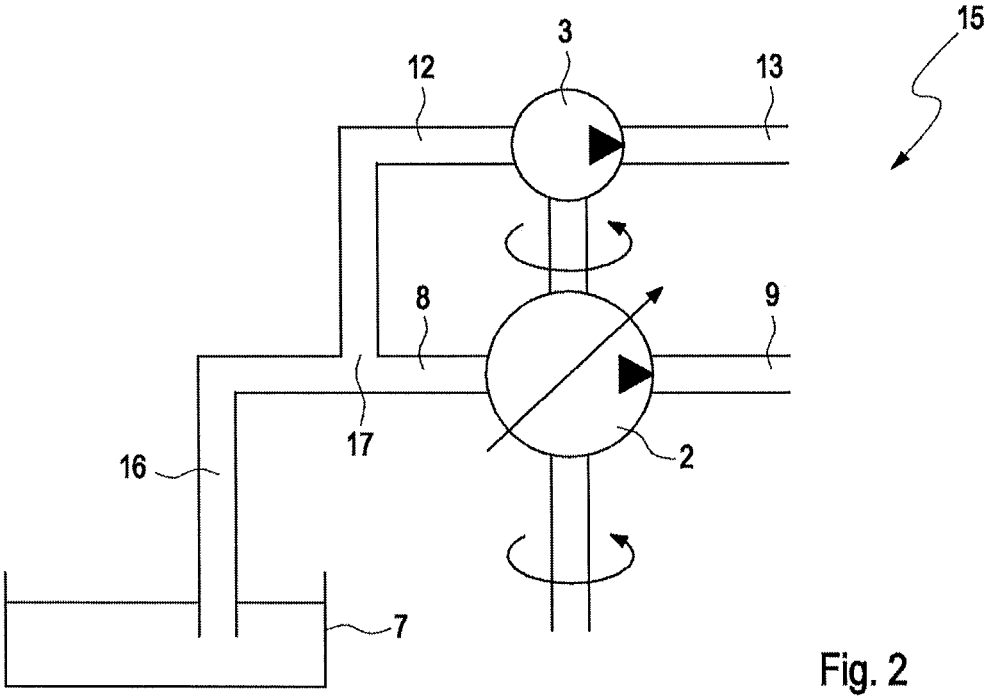
FIG. 2: a second possible embodiment of a fluid pump arrangement in a schematic view.

In FIG. 2, a different fluid pump arrangement 15 is shown in a schematic circuitry. Significant parts of the fluid pump arrangement 15 are similar to the fluid pump arrangement 1 according to FIG. 1, so for similar parts (or even identical parts), identical reference numerals are chosen. For brevity, the synthetically commutated fluid pump 2 is not shown in detail, but only as a graphic symbol.

Different from the previous embodiment, a common low-pressure line 16 is used in the present embodiment, through which hydraulic oil is sucked in from the fluid reservoir 7. At branching point 17, the common low-pressure line 16 is split up into two different low-pressure lines 8, 12, serving the synthetically commutated fluid pump 2 and the fixed displacement pump 3, respectively. The branching point 17 is arranged to be at the same level or to be higher than the position of the synthetically commutated fluid pump 2.

On start-up, the fixed displacement pump 3 will start to intake oil from the fluid reservoir 7 through common low-pressure line 16 and "dedicated" low-pressure line 12, replacing the entrapped air, while the synthetically commutated fluid pump 2 will be initially in a "stuck mode". Due to the positioning of the branching point 17 and the action of the fixed displacement pump 3, the low-pressure line 8, serving the synthetically commutated fluid pump 2, will fill up with hydraulic oil as well, as soon as the oil level reaches and eventually exceeds the height of the branching point 17. Due to this, the synthetically commutated fluid pump 2 will be able to start pumping hydraulic oil "on its own", albeit initially with a reduced performance due to the residual entrapped air. However, with time, the fluid pump arrangement 15 according to FIG. 2 will fill up completely, resulting in a fully vented arrangement 15 that is able to run at nominal performance.

In particular, a fluid intake through the common low-pressure line 16 (and/or also "dedicated" low-pressure line 12) may continue, even when the start-up sequence of the synthetically commutated fluid pump 2 is sufficiently proceeded/completed. No on-off-fluid valve is needed for this purpose. The respective fluid passage may be present permanently.

Figure 3:
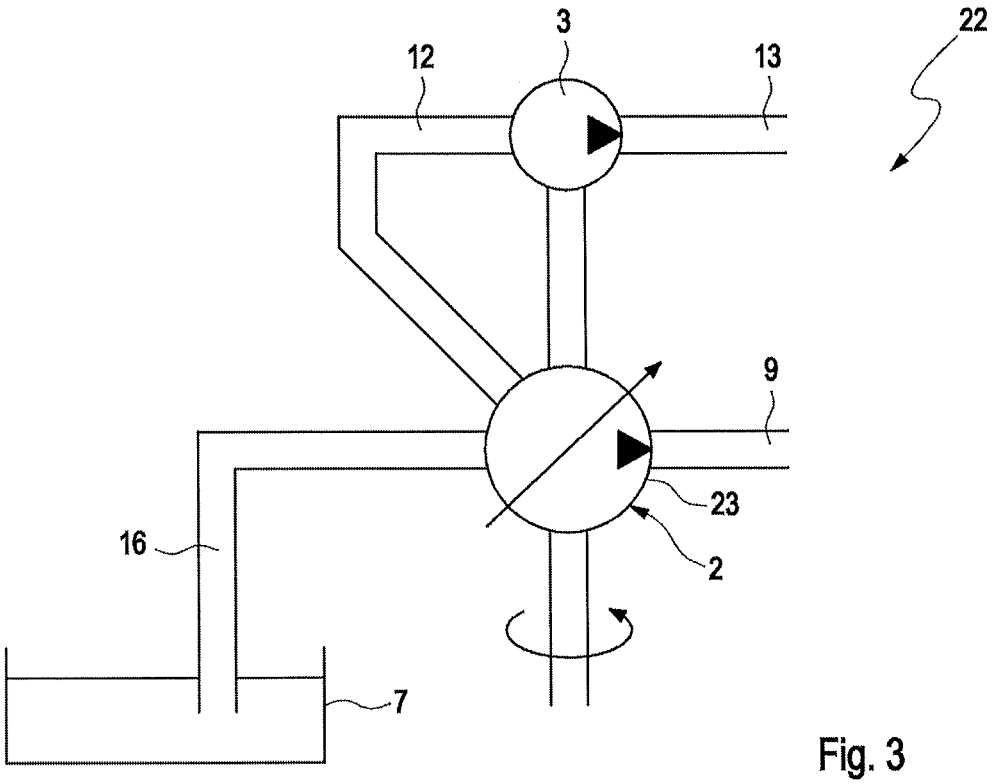
FIG. 3: a third possible embodiment of a fluid pump arrangement in a schematic view.

In FIG. 3, a fluid pump arrangement 22 is shown that constitutes a slight variation of the fluid pump arrangement 15 according to FIG. 2. The basic difference between the two fluid pump arrangements 15 (FIG. 2) and 22 (FIG. 3) is the rearrangement of the fluid input lines 8, 12, 16, connecting the two fluid pumps 2, 3 to the fluid reservoir 7.

According to the third embodiment of a fluid pump arrangement 22 as shown in FIG. 3, the low-pressure line 12 of fixed displacement pump 3 does not directly connect to the low-pressure line 8 of synthetically commutated fluid pump 2 by means of a branching point 17. Instead, the low-pressure line 12 of fixed displacement pump 3 inputs the fluid from inside the housing 23 of synthetically commutated fluid pump 2. In the presently described embodiment, the fluid intake takes place from the crankcase (not shown) of the synthetically commutated fluid pump 2. However, a different suitable part or area/volume of the synthetically commutated fluid pump 2 could be chosen for the fluid intake into low-pressure line 12 of fixed displacement pump 3 as well. Despite of the different arrangement, the functionality of this design is similar to the design as shown in FIG. 2 and reference is made to the previous description.

In particular, a fluid intake through "dedicated" low-pressure line 12 may continue, even when the start-up sequence of the synthetically commutated fluid pump 2 is sufficiently proceeded/completed. No on-off-fluid valve is needed for this purpose. The respective fluid passage may be present permanently.

Figure 4:
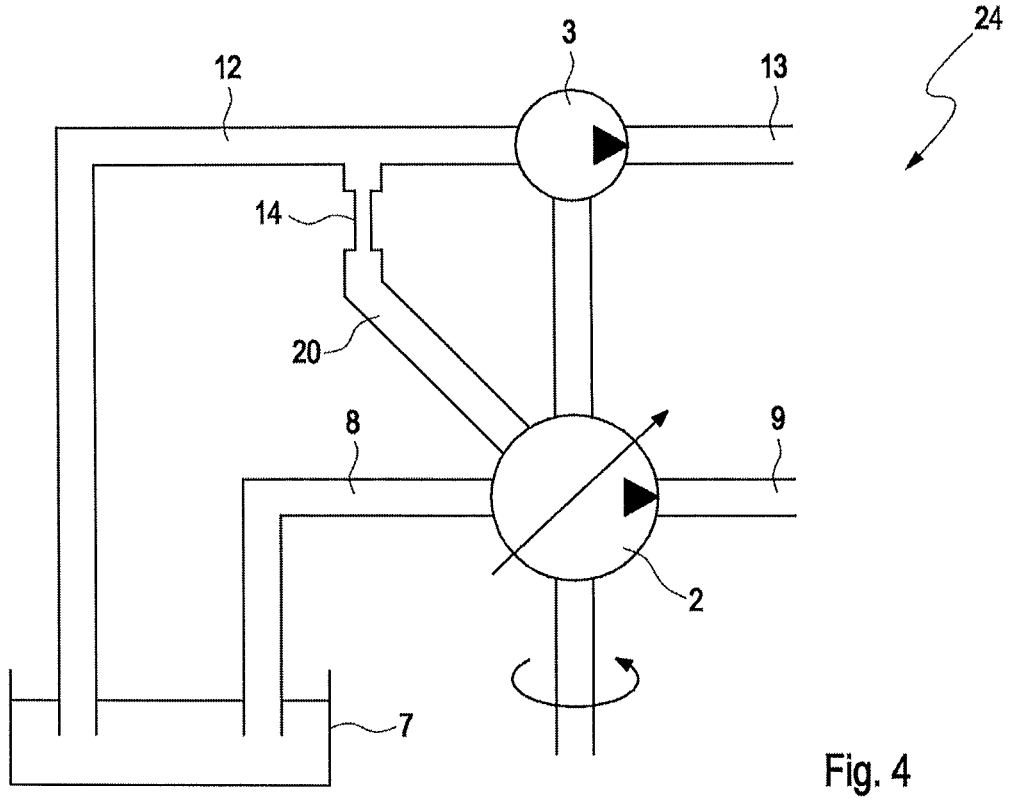
FIG. 4: a fourth possible embodiment of a fluid working machine arrangement in a schematic view.

A yet other modification of a fluid pump arrangement 24 is shown in FIG. 4. This embodiment is in a certain sense a combination of the embodiments of a fluid pump arrangement 1, 22, as shown in FIGS. 1 and 3, respectively. Namely, the low-pressure line 12 of fixed displacement pump 3 essentially connects to a fluid reservoir 7 (in particular with respect to the maximum achievable fluid flow and/or the tube diameters). However, similar to the embodiment of a fluid pump arrangement 1 as shown in FIG. 1, a branching point is arranged in low-pressure line 12, so that a venting line 20 branches off and connects via fluid throttle 14 (either comprising an orifice of a fixed size and/or an orifice of a variable size, similar to fluid pump arrangement 1 according to FIG. 1) to the synthetically commutated fluid pump 2 (similar to the fluid pump arrangement 22, as shown in FIG. 3). The area/volume, where the fluid intake from synthetically commutated fluid pump 2 is effectuated can be essentially a volume part inside the housing of the synthetically commutated fluid pump 2 that is (particularly) prone to an accumulation of air. In particular, the respective fluid orifice can be arranged at the more or less uppermost part of the respective volume, so that the entrapped air can be removed essentially completely. However, a "vertically lower" arrangement of the orifice can be used as well, as long as a start-up of the synthetically commutated fluid pump 2 can be realised in a sufficiently fast and reliable way.

The advantage of the embodiment of a fluid pump arrangement 24 according to FIG. 4 is that, contrary to the embodiment of a fluid pump arrangement 22 according to FIG. 3, the fixed displacement pump 3 can be used as a hydraulic supply pump for hydraulic consumers (even those necessitating a significant fluid flux). This is due to the fact that a sufficiently high fluid flux can be realised through fixed displacement pump 3 without interfering too much with the interior fluid flow behaviour of synthetically commutated fluid pump 2, since the major part of the fluid flux can originate from fluid reservoir 7 (or a different fluid source).

In particular, a fluid intake through venting line 20, fluid throttle 14 and/or the appropriate section of the low-pressure line 12 may continue, even when the start-up sequence of the synthetically commutated fluid pump 2 is sufficiently proceeded/completed. No on-off-fluid valve is needed for this purpose. The respective fluid passage may be present permanently.

Figure 5:
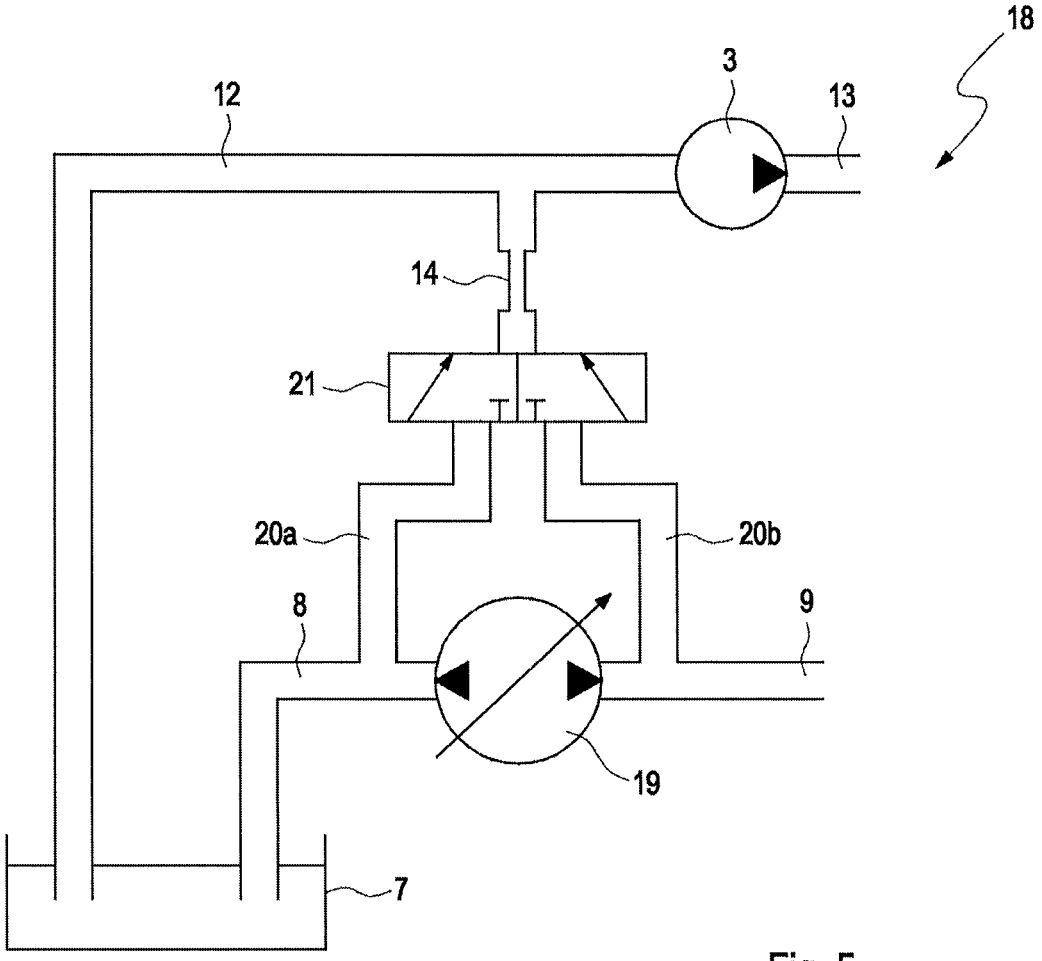
FIG. 5: a fifth possible embodiment of a fluid working machine arrangement in a schematic view.

In FIG. 5, another variation of a fluid working machine arrangement 18 is shown. Again, the fluid working machine arrangement 18 shows quite some similarities to the fluid pump arrangements 1, 15 according to FIGS. 1 and 2. Presently, however, the synthetically commutated fluid pump is replaced by a synthetically commutated fluid working machine 19. In the synthetically commutated fluid working machine 19, both low-pressure and high-pressure valves are replaced by electrically actuated valves (which is as such known in the state-of-the-art). When an appropriate actuation of the low-pressure and the high-pressure valves is performed, it is possible to operate the synthetically commutated fluid machine 19 both in a pumping mode (fluid movement from the left to the right in FIG. 5), and in a motoring mode (fluid movement from the right to the left in FIG. 5).

Air might be entrapped on both sides of the synthetically commutated fluid working machine 19, namely in the low-pressure line 8 and the high-pressure line 9 on start-up of the synthetically commutated fluid working machine 19, leading to a "stuck condition". Therefore, a venting line 20*a*, 20*b* connects to low-pressure line 8 and high-pressure line 9, respectively. The venting lines 20*a*, 20*b* fluidly connects the low-pressure line 8/the high-pressure line 9 to the low-pressure line 12 of the fixed displacement pump 3 through fluid throttle 14. As previously discussed, low-pressure line 12 will be successively filled with hydraulic oil, thus replacing any air in low-pressure line 12 that is present on start-up of the fixed displacement pump 3.

Depending on the operating mode 19 of the synthetically commutated fluid working machine 19, a shuttle valve 21 is switched to an appropriate position, so that the appropriate venting line 20*a*, 20*b* connects the current intake side of the synthetically commutated fluid working machine 19 with the low-pressure line 12 through fluid throttle 14. Therefore, the current fluid intake line 8, 9 can be vented, so that a start-up of the synthetically commutated fluid working machine 19 is possible.

In particular, a fluid intake through (one of) the venting line(s) 20*a*, 20*b* into the fluid throttle 14 may continue, even when the start-up sequence of the synthetically commutated fluid pump 2 is sufficiently proceeded/completed. No on-off-fluid valve is needed for this purpose. The respective fluid passage may be present permanently.

In the present context, it should be mentioned that the synthetically commutated fluid working machine 19 can be operated as a pump and/or as a motor in both directions. Therefore, a mode is possible as well, in which fluid is actively transported from the right side to the left side by means of synthetically fluid working machine 19, so that the pressure in the high-pressure line 9 can be even lower as compared to the pressure on the low-pressure line 8 under certain operating conditions. Therefore, a venting on both sides of the synthetically commutated fluid working machine 19 might prove to be essential.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A fluid working machine arrangement, comprising a synthetically commutated hydraulic fluid working machine, having at least one working chamber with at least one actuated valve, wherein said at least one actuated valve fluidly communicates with a connecting fluid conduit, wherein said connecting fluid conduit comprises at least one venting device that is fluidly connected to a fluid intake device, wherein a high pressure line of the synthetically commutated hydraulic fluid working machine and a high pressure line of the fluid intake device are arranged in parallel, and wherein operation of the fluid intake device on start-up causes air entrapped in a low pressure line of the synthetically commutated hydraulic fluid working machine to enter a low pressure line of the fluid intake device.

2. The fluid working machine arrangement according to claim 1, wherein said synthetically commutated hydraulic fluid working machine comprises a plurality of working chambers, wherein preferably a plurality of working chambers connect to a common connecting fluid conduit.

3. The fluid working machine arrangement according to claim 1, wherein for at least one of said at least one working chamber said at least one actuated valve connects to a common connecting fluid conduit and/or wherein at least part of said synthetically commutated hydraulic fluid working machine is designed as a synthetically commutated hydraulic fluid pump.

4. The fluid working machine arrangement according to claim 1, wherein said synthetically commutated hydraulic fluid working machine comprises at least one working chamber with at least two actuated valves, wherein said at least two actuated valves preferably connect to different connecting fluid conduits.

5. The fluid working machine arrangement according to claim 4, wherein for at least two different connecting fluid conduits each of said fluid conduit comprises a venting device, wherein preferably fluid switches are used to selectively connect to said venting devices with said fluid intake device.

6. The fluid working machine arrangement according to claim 1, wherein said at least one venting device is designed, at least in part, as a fluid orifice and/or as a check valve device and/or as a single way fluid throughput device.

7. The fluid working machine arrangement according to claim 6, wherein said at least one fluid intake device is designed as an active fluid intake device.

8. The fluid working machine arrangement according to claim 7, wherein said synthetically commutated fluid working machine is designed and arranged for use in an open fluid hydraulic circuit and/or in that at least said synthetically commutated fluid working machine fluidly connects to at least a fluid reservoir, either directly and/or indirectly.

9. The fluid working machine arrangement according to claim 7, wherein said at least one fluid intake device is designed and arranged for use in an open fluid hydraulic circuit and/or in that it connects to said at least one venting device and/or to at least one alternative fluid source, in particular to a fluid reservoir.

10. The fluid working machine arrangement according to claim 9, wherein said at least one venting device and/or the fluid connection between said at least one venting device and said fluid intake device comprises a fluid throughput restriction means and/or is designed, at least in part, as a fluid throughput restriction means, wherein said fluid throughput restriction means is preferably a fixed and/or a variable fluid throughput restriction means.

11. The fluid working machine arrangement according to claim 1, wherein said at least one venting device is arranged at least in the vicinity of the locally highest point of the respective connecting fluid conduit.

12. The fluid working machine arrangement according to claim 1, wherein said at least one venting device connects to said synthetically commutated hydraulic fluid working machine.

13. The fluid working machine arrangement according to claim 2, wherein for at least one of said plurality of working chambers said at least one actuated valve connects to a common connecting fluid conduit and/or wherein at least part of said synthetically commutated hydraulic fluid working machine is designed as a synthetically commutated hydraulic fluid pump.

14. The fluid working machine arrangement according to claim 2, wherein said synthetically commutated hydraulic fluid working machine comprises at least one working chamber with at least two actuated valves, wherein said at least two actuated valves preferably connect to different connecting fluid conduits.

15. The fluid working machine arrangement according to claim 2, wherein said at least one venting device is designed, at least in part, as a fluid orifice and/or as a check valve device and/or as a single way fluid throughput device.

16. The fluid working machine arrangement according to claim 3, wherein said at least one venting device is designed, at least in part, as a fluid orifice and/or as a check valve device and/or as a single way fluid throughput device.

17. The fluid working machine arrangement according to claim 4, wherein said at least one venting device is designed, at least in part, as a fluid orifice and/or as a check valve device and/or as a single way fluid throughput device.

18. The fluid working machine arrangement according to claim 5, wherein said at least one venting device is designed, at least in part, as a fluid orifice and/or as a check valve device and/or as a single way fluid throughput device.

19. The fluid working machine arrangement according to claim 7, wherein said at least one fluid intake device is designed as an active fluid intake device taken from the group comprising fluid working machines, fixed displacement fluid working machines, variable displacement fluid working machines, cogwheel fluid working machines, piston fluid working machines, passive-valve fluid working machines, non-synthetically commutated fluid working machines, scroll fluid working machines, Gerotor fluid working machines, fluid pumps, fixed displacement fluid pumps, variable displacement fluid pumps, cogwheel fluid pumps, piston fluid pumps, passive valve fluid pumps, non-synthetically commutated fluid pumps, scroll fluid pumps, and Gerotor fluid pumps.

20. The fluid working machine arrangement according to claim 12, wherein said at least one venting device connects to an interior part of said synthetically commutated hydraulic fluid working machine.

21. The fluid working machine arrangement according to claim 1, wherein the high pressure line of the synthetically commutated hydraulic fluid working machine and the high pressure line of the fluid intake device are configured to connect to different hydraulic consumers.

22. A method of venting a synthetically commutated fluid working machine, wherein at least one connecting fluid conduit, connecting said synthetically commutated fluid working machine with a different hydraulic device, is vented at least at times of a working interval of said synthetically commutated fluid working machine, using a fluid intake device, wherein a high pressure line of the synthetically commutated fluid working machine and a high pressure line of the fluid intake device are arranged in parallel, and wherein operation of the fluid intake device on start-up causes air entrapped in a low pressure line of the synthetically commutated hydraulic fluid working machine to enter a low pressure line of the fluid intake device.

23. The method according to claim 22, wherein it is employed for a fluid working machine arrangement comprising a synthetically commutated hydraulic fluid working machine, having at least one working chamber with at least one actuated valve, wherein said at least one actuated valve fluidly communicates with a connecting fluid conduit, wherein said connecting fluid conduit comprises at least one venting device that is fluidly connected to a fluid intake device.

24. The method according to claim 22, wherein the high pressure line of the synthetically commutated hydraulic fluid working machine and the high pressure line of the fluid intake device are configured to connect to different hydraulic consumers.

* * * * *